US007517247B2

(12) United States Patent
Hiramatsu

(10) Patent No.: US 7,517,247 B2
(45) Date of Patent: Apr. 14, 2009

(54) CONNECTOR

(75) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/134,253

(22) Filed: Jun. 6, 2008

(65) Prior Publication Data

US 2008/0305681 A1 Dec. 11, 2008

(30) Foreign Application Priority Data

Jun. 6, 2007 (JP) ..... 2007-149928

(51) Int. Cl.
*H01R 13/40* (2006.01)

(52) U.S. Cl. ..... 439/595

(58) Field of Classification Search ..... 439/595, 439/598, 752, 744, 871, 752.5, 884, 885
See application file for complete search history.

(56) References Cited

U.S. PATENT DOCUMENTS 5,607,327 A * 3/1997 Tsuji et al. ..... 439/752
6,375,502 B2 * 4/2002 Yoshida et al. ..... 439/595
6,851,977 B2 2/2005 Tsuji
6,935,893 B1 * 8/2005 Flowers et al. ..... 439/595

* cited by examiner

*Primary Examiner*—Edwin A. Leon
(74) *Attorney, Agent, or Firm*—Gerald E. Hespos; Anthony J. Casella

(57) ABSTRACT

A male terminal fitting (20A) is inserted into a cavity (11) in a housing (10) from the rear, and has a tab (26A) that passes through an open portion (16) of a front wall (14) of the cavity (11). A proximal portion (27A) of the tab (26A) is sandwiched in a thickness direction between an inner surface of the open portion (16) and a front closure (30) mounted on the open portion (16). The thickness of the proximal portion (27A) of the tab (26A) of the terminal fitting (20A) is less than that of a connection portion (28A) of the tab (26A). Therefore the connection portion (28A) of the tab (26A) can have a thickness different from a predetermined thickness, provided that the proximal portion (27A) of the tab (26A) has the predetermined thickness.

15 Claims, 8 Drawing Sheets

CONNECTOR

BACKGROUND OF THE INVENTION

1. Field of the Invention

The invention relates to a connector and a terminal fitting.

2. Description of the Related Art

U.S. Pat. No. 6,851,977 discloses a male connector with a housing having opposite front and rear ends. A cavity extends through the housing and has an open portion at the front end. A male terminal fitting is inserted into the cavity from the rear end of the housing and has a tab that extends forward into the open portion. A front closure is mounted to the front of the housing and closes the region of the open portion of the cavity. The proximal portion of the tab disposed near the terminal fitting body is sandwiched in the thickness direction of the tab between the front closure and the inner surface of the open portion of the housing to prevent the tab from loosening in the thickness direction thereof.

A demand has existed in recent years to decrease the production cost by providing connectors with several types of terminal fittings having tabs different thickness. However, the above-described connector is constructed so that the tab is sandwiched in the thickness direction thereof between the front closure and the inner surface of the open portion of the cavity to prevent the tab from loosening in the thickness direction. Thus, several types of front closures are required according to the thickness of the tab, and the cost of producing the connector remains high.

The invention has been completed in view of the above-described situation. Therefore an object of the invention is to provide a connector for accommodating plural types of terminal fittings without altering a front closure thereof.

SUMMARY OF THE INVENTION

The invention relates to a connector that has a housing with opposite front and rear ends and a front wall at the front end. A cavity extends between the front and rear ends of the housing and includes an open portion adjacent the front wall of the housing. The connector also includes a terminal fitting that is inserted forwardly into the cavity from the rear end of the housing. The terminal fitting includes a body and thin tab is formed at the front end of the body. The tab projects through the open portion of the cavity at the front of the housing and is configured to be connected with a mating terminal fitting. A front closure is mounted on the front end of the housing and closes at least part of the open portion of the cavity. A proximal portion of the tab disposed between the body of the terminal fitting and the connection portion of the tab is sandwiched in a thickness direction of the tab between the front closure and an inner surface of the open portion when the front closure is mounted. The proximal portion of the tab is thinner than the connection portion thereof. Thus, without altering the type of the front closure, it is possible to mount a terminal fitting in which the connection portion of the tab has a thickness different from a predetermined thickness, provided that the proximal portion of the tab has a predetermined thickness. Accordingly, a terminal fitting having equal thicknesses in the connection portion of the tab thereof and the proximal portion of the tab can be employed.

The proximal portion of the tab preferably has a length that exceeds a thickness of the front closure corresponding to the connection portion.

The front closure preferably is movable between a detection position on the open portion of the housing and a wait position forward from the detection position. A terminal fitting that is in a partly-inserted state prevents the front closure from moving from the wait position to the detection position. However, the front closure is allowed to move from the wait position to the detection position when the terminal fitting is inserted to a normal position. Thus, the front closure detects the insertion state of the terminal fitting, and there is no need to provide an insertion detection member separate from the front closure. As a result, the number of parts of the connector can be decreased.

A lance preferably is formed on an inner surface of the cavity and is elastically flexible in a direction intersecting a direction in which the terminal fitting is inserted into the cavity. The lance elastically flexes while inserting the terminal fitting into the cavity. The lance then returns resiliently to an original state when the terminal fitting is inserted to the normal position for locking the terminal fitting in the cavity. At least part of the front closure is at the same side as a direction in which the lance flexes.

The connection portion of the tab of the terminal fitting may protrude lower than the proximal portion of the tab and towards the front closure. In this case, the connection portion interferes with the front closure when the terminal fitting is inserted into the cavity while the front closure is at the wait position. At this time, the terminal fitting inclines up towards the front due to the elastic flexing of the lance. Therefore, interference of the connection portion with the front closure will not cause the tab to generate an excessively large stress.

DETAILED DESCRIPTION OF THE PREFERRED EMBODIMENTS

Figure 1:
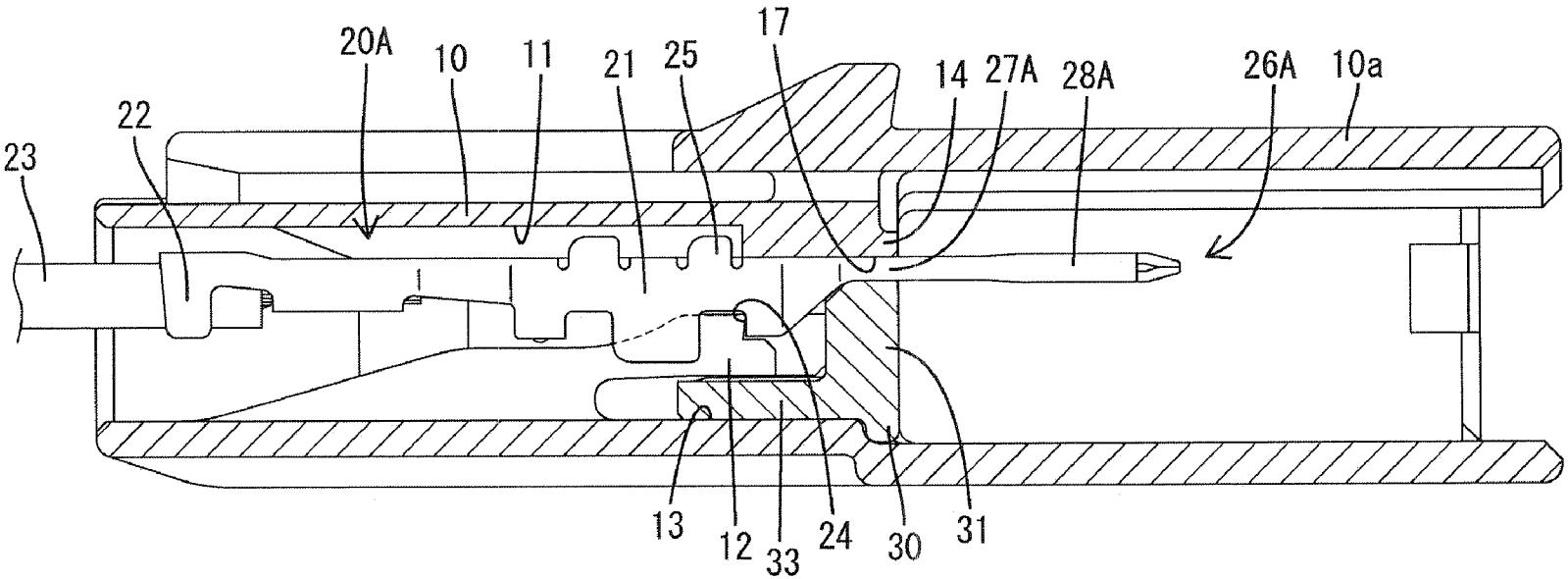
FIG. 1 is a cross sectional view showing a first terminal fitting in accordance with a first embodiment inserted into a normal position and a front closure disposed at a detection portion.

A first embodiment of the invention is described below with reference to FIGS. 1 through 9. The connector of the first embodiment includes a housing 10, a first terminal fitting 20A, a second terminal fitting 20B, and a front closure 30.

The housing 10 is made of synthetic resin and is substantially block-shaped. Narrow left and right cavities 11 are formed in a longitudinal direction of the housing 10 and a lance 12 is cantilevered forward along an inner bottom surface of each cavity 11. The lance 12 is elastically flexible away from an insertion path of the terminal fittings 20A, 20B and into a flexible space 13 formed below the lance 12 in a direction perpendicularly intersecting the direction in which the terminal fittings 20A, 20B are inserted into the cavity 11. A terminal fitting insertion opening is formed at the rear end of the cavity 11. A front wall 14 extends across the front of both cavities 11 and a mounting space 15 is recessed in a front portion of the front wall 14 extending across both cavities 11. The mounting space 15 includes an open portion 16 that communicates with both cavities 11. Left and right fit-in concavities 17 are formed at an upper edge of the open portion 16 at positions corresponding respectively with the cavities 11. Locking spaces 18 are disposed in the mounting space 15 at outer lateral sides of the cavities 11. A temporary locking projection 19*a* and a main projection 19*b* are formed inside each locking space 18. A square pillar-shaped tubular hood 10*a* extends forward from the front wall 14 of the cavity 11.

The first terminal fitting 20A is long and narrow and includes a terminal fitting body 21. A tab 26A extends forward from the terminal fitting body 21, and an electric wire-crimping portion 22 extends rearward from the terminal fitting body 21. The electric wire-crimping portion 22 is crimped into electrically conductive connection with an end portion of an electric wire 23. A lock 24 is formed by recessing a lower surface of a front portion of the terminal fitting body 21 and a front stop 25 projects from an upper surface of the front portion of the terminal fitting body 21.

A plate-shaped portion of the first terminal fitting 20A extends forward from the terminal fitting body 21 and is folded longitudinally so that upper and lower folded plate-shaped portions overlap to form the tab 26A of the first terminal fitting 20A. The tab 26A has a smaller thickness than the terminal fitting body 21 over the entire length thereof and has a constant width over the entire length thereof. A proximal portion 27A is defined at a rear region of the tab 26A continuous with the terminal fitting body 21. A connection portion 27A extends along a region of the tab 26A forward of the proximal portion 27A and can be connected with a mating terminal (not shown). An upper surface of the connection portion 28A is stepped up from an upper surface of the proximal portion 27A and a lower surface of the connection portion 28A is stepped down from a lower surface of the proximal portion 27A. Thus, the connection portion 28A is thicker than the proximal portion 27A. The tab 26A has a vertically symmetrical configuration when the tab 26A viewed sideways. A thickness dimension "ta" of the proximal portion 27A of the tab 26A is approximately 0.64 mm in the first embodiment. A thickness dimension "tb" of the connection portion 28A is approximately 0.8 mm. The thickness dimensions "ta" and "tb" can be set arbitrarily. A longitudinal length "Lb" of the proximal portion 27A exceeds a longitudinal length "La" of the connection portion 28A.

The second terminal fitting 20B is long and narrow and includes a terminal fitting body 21. A tab 26B extends forward from the terminal fitting body 21, and an electric wire-crimping portion 22 extends rearward from the terminal fitting body 21. The terminal fitting body 21 and the electric wire-crimping portion of the second terminal fitting 20B are configured identically to the corresponding parts of the first terminal fitting 20A.

A plate-shaped portion of the second terminal fitting 20B extends forward from the terminal fitting body 21 and is folded longitudinally so that upper and lower folded plate-shaped portions overlap each other to form the tab 26B. The tab 26B is thinner than the terminal fitting body 21 over the entire length thereof and has a constant width over the whole length thereof. A proximal portion 27B is defined at a rear region of the tab 26B continuous with the terminal fitting body 21. A connection portion 28B extends along a region of the tab 26B forward from the proximal portion 27B. An upper surface of the connection portion 28B is continuous and flush with an upper surface of the proximal portion 27B and a lower surface of the connection portion 28B is continuous and flush with a lower surface of the proximal portion 27B. Thus, the connection portion 28B has a thickness approximately equal to the thickness the proximal portion 27B. The tab 26B of the second terminal fitting 20B has a thickness "ta" of approximately 0.64 mm, which is approximately equal to the thickness "ta" of the proximal portion 27A of the tab 26A of the first terminal fitting 20A.

Figure 5:
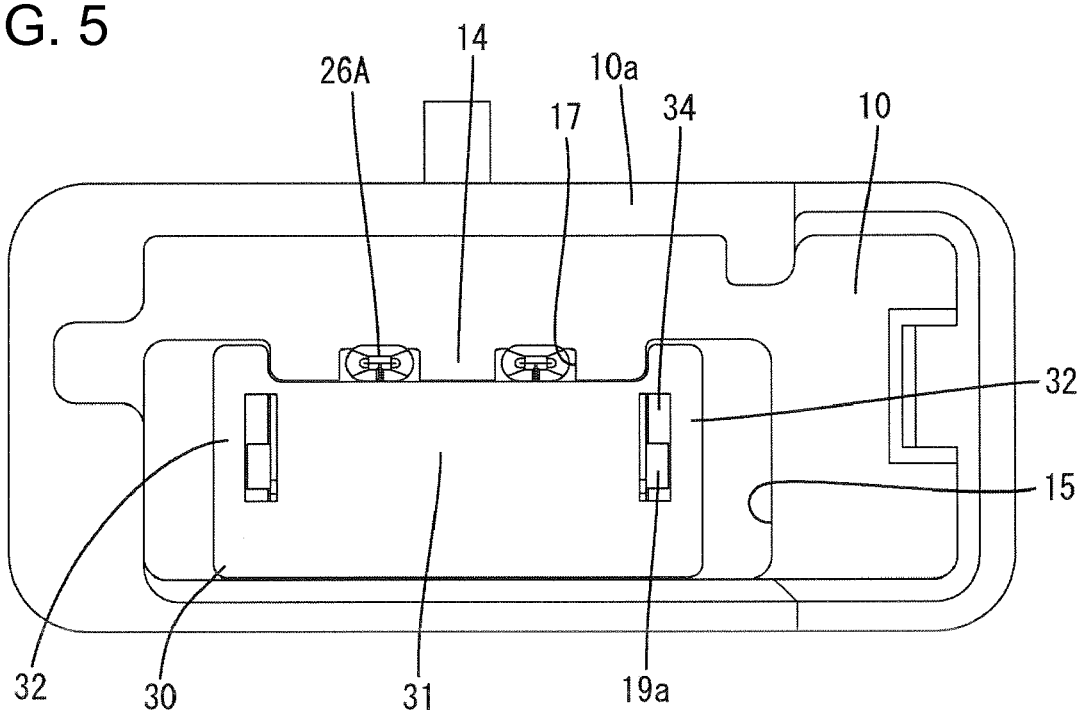
FIG. 5 is a front view that shows the front closure mounted on a housing.
Figure 6:
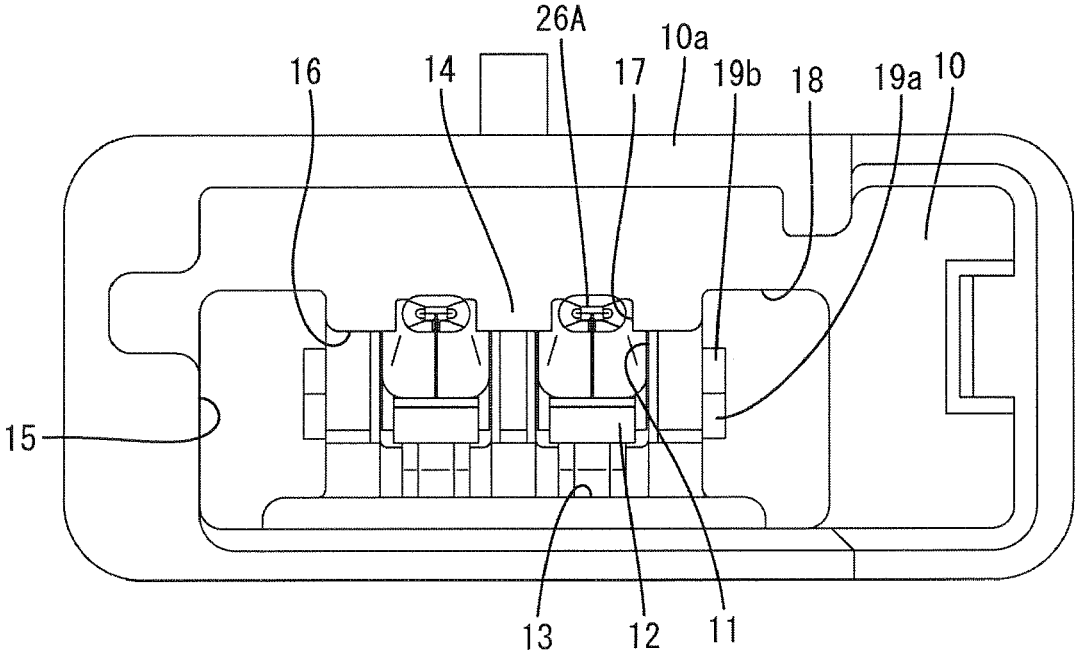
FIG. 6 is a front view showing the front closure removed from the housing.
Figure 7:
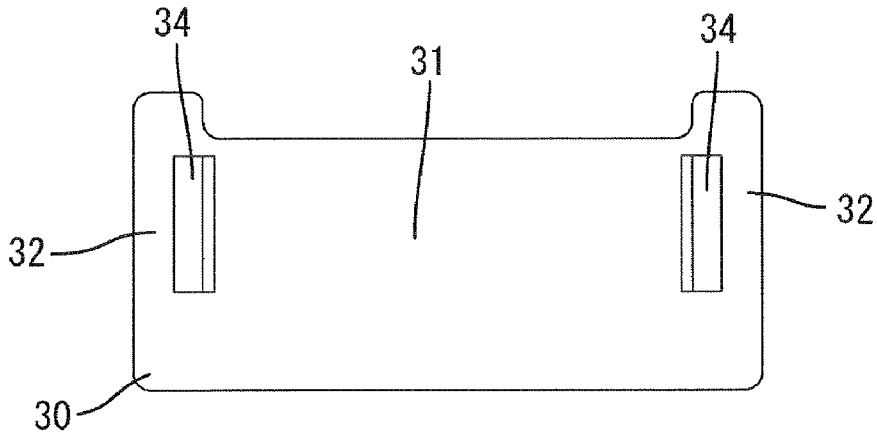
FIG. 7 is a front view showing the front closure.
Figure 8:
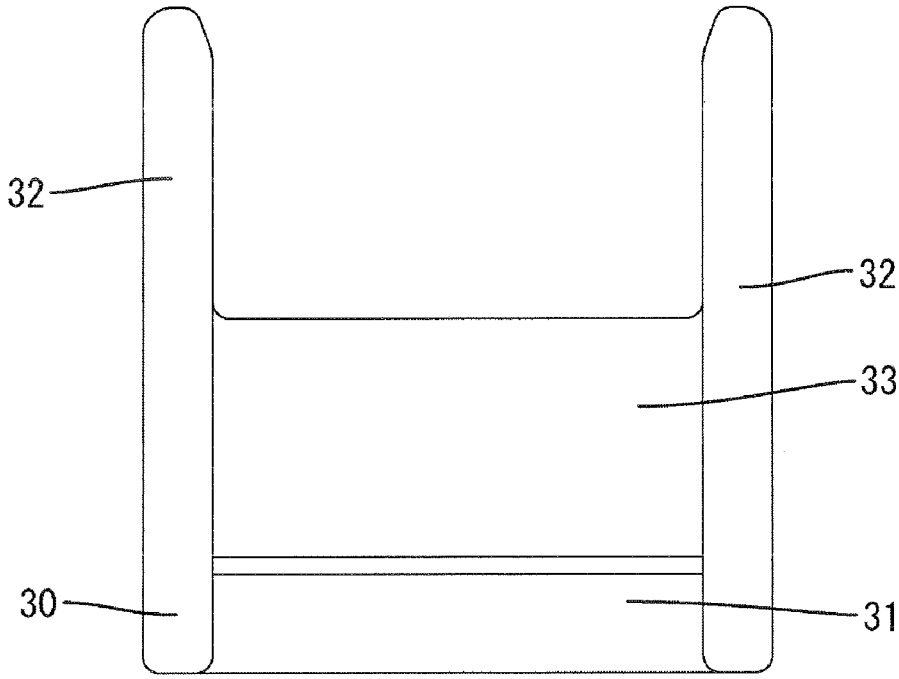
FIG. 8 is a top plan view showing the front closure.
Figure 9:
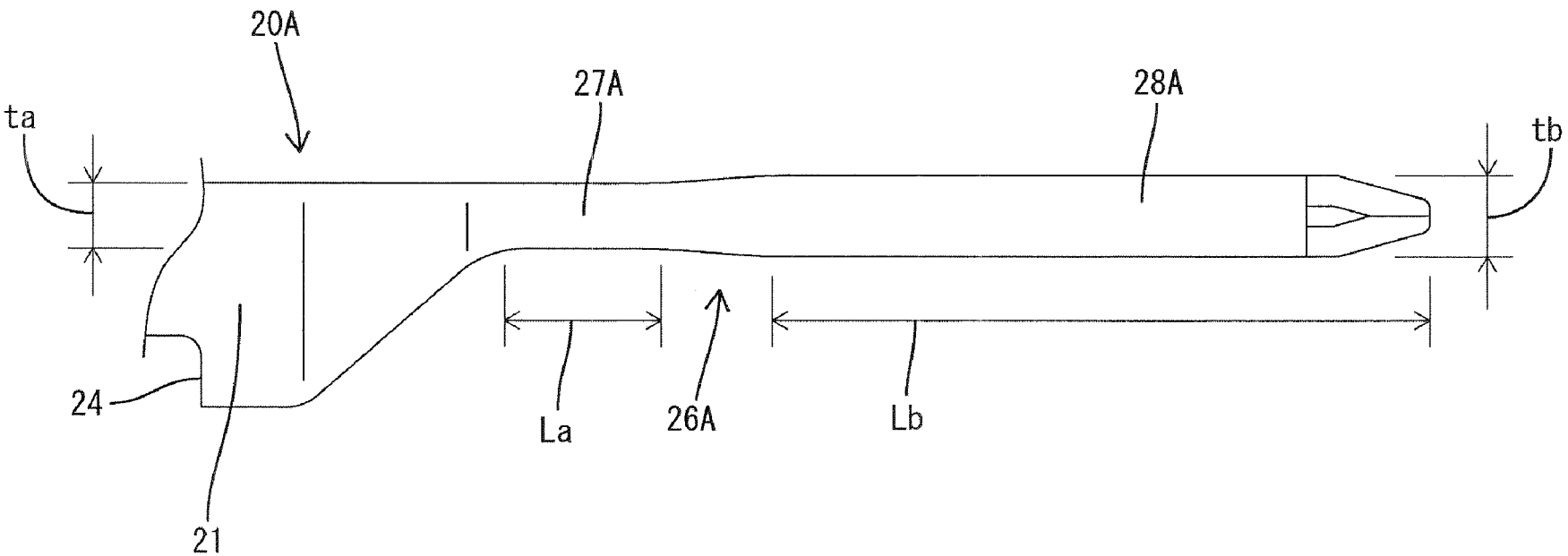
FIG. 9 is a side view in which a tab of the first terminal fitting is partly enlarged.

The front closure 30 is made unitarily of synthetic resin and includes an approximately rectangular covering wall 31, two plate-shaped arms 32 that extend rearward from the left and right side edges of the covering wall 31, and a plate-shaped detector 33 that extends rearward from a lower edge of the covering wall 31. As shown in FIG. 5, a locking claw 34 is formed on an inner surface of a rear end of each arm 32. A thickness dimension (longitudinal dimension) of the covering wall 31 is less than a longitudinal dimension of the proximal portion 27A of the tab 26A of the first terminal fitting 20A. Thus, the longitudinal dimension of the proximal portion 27A exceeds the longitudinal dimension of a region of the front closure 30 corresponding to the connection portion 28A.

Figure 2:
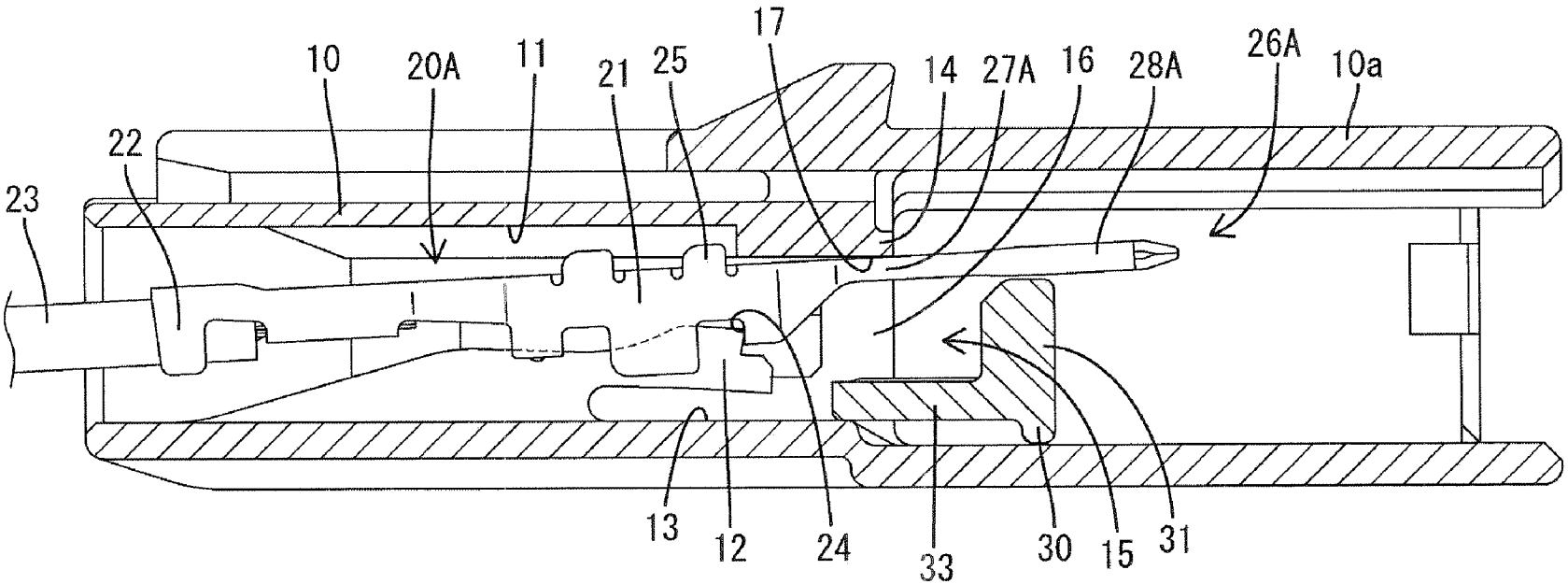
FIG. 2 is a sectional view showing the first terminal fitting inserted into the normal position and the front closure disposed at a wait position.
Figure 3:
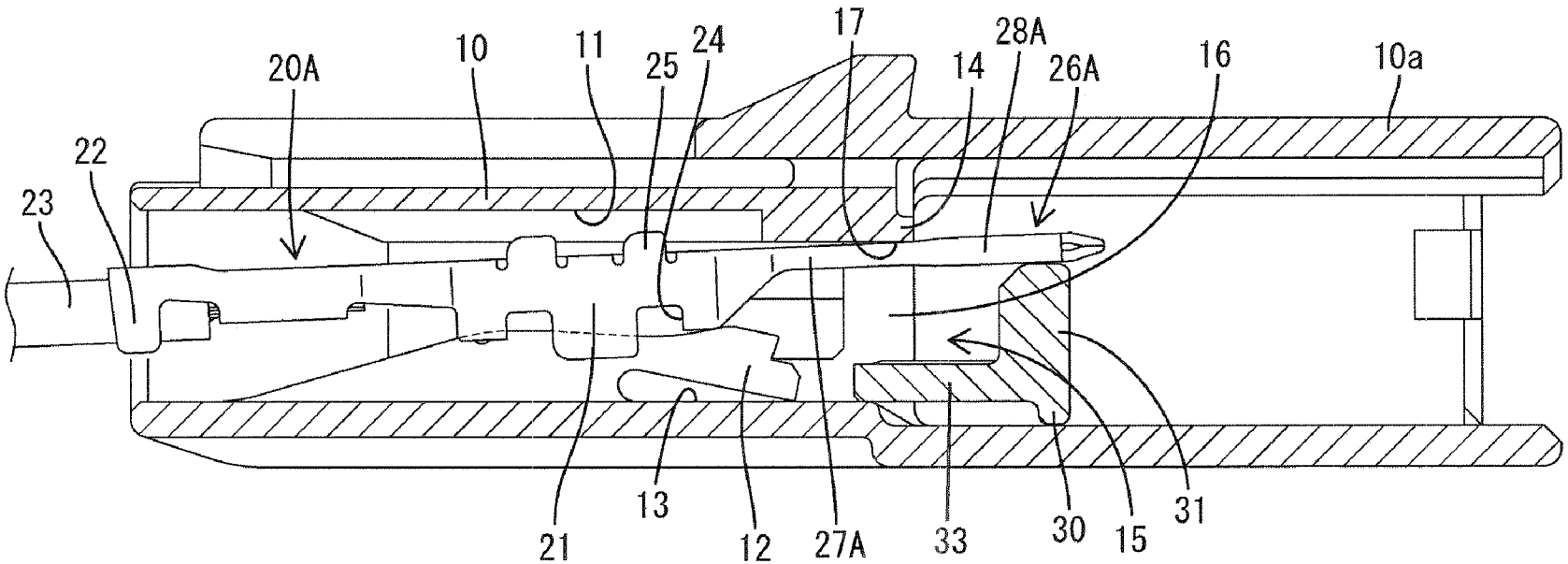
FIG. 3 is a cross sectional view showing a state in which the first terminal fitting is being inserted into the cavity.
Figure 4:
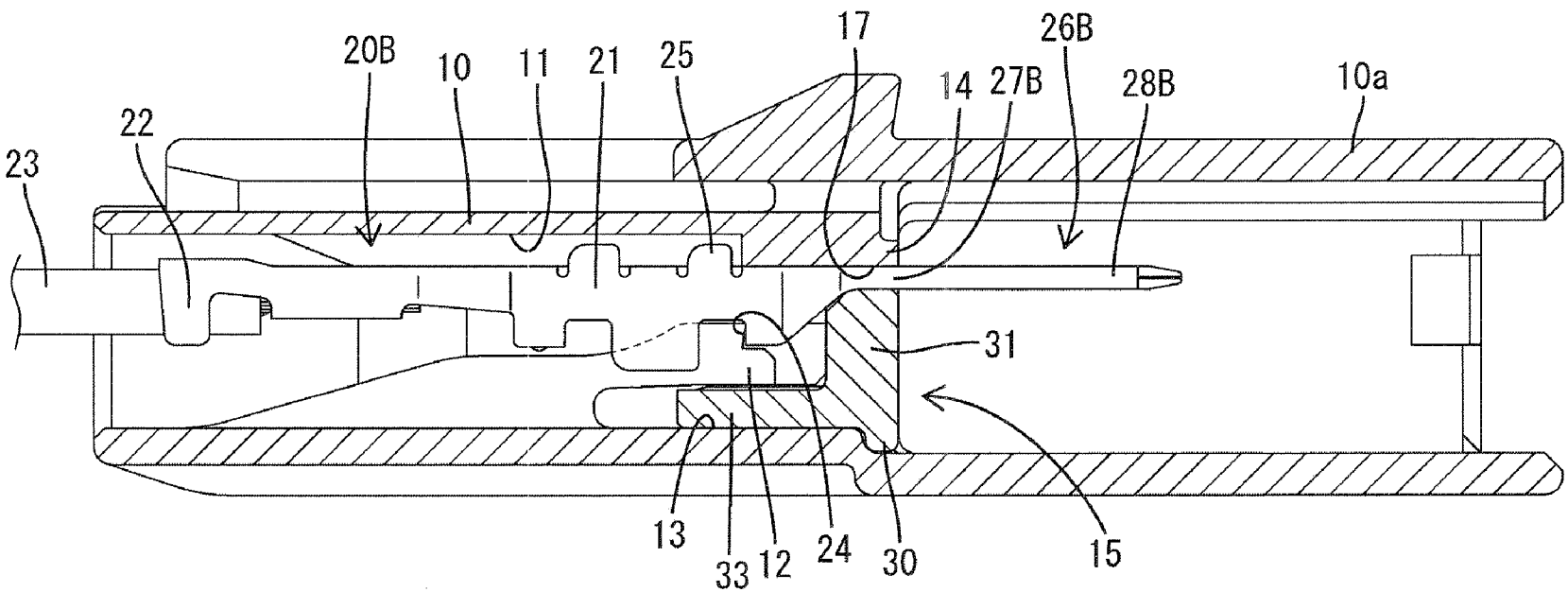
FIG. 4 is a cross sectional view showing a second terminal fitting inserted into a normal position and the front closure at a detection portion.

The locking claw 34 can be locked to the temporary locking projection 19*a* in the hood 10*a* to hold the front closure 30 at a wait position where the covering panel 31 is disposed forward from the front wall 14 of the cavity 11, as shown in FIGS. 2 and 3. On the other hand, the locking claw 34 can be locked to the main locking projection 19*b* in the hood 10*a* to hold the front closure 30 at a detection position where the covering panel 31 is accommodated inside the open portion 16, as shown in FIGS. 1 and 4. The front closure 30 is held at the wait position while inserting the terminal fitting into the cavity 11. The movement direction of the front closure 30 between the wait position and the detection position is parallel with the longitudinal direction of the tabs 26A, 26B as the terminal fittings 20A, 20B are inserted into the normal positions of the cavity 11, and hence parallel with the direction in which the terminal fittings 20A, 20B are inserted into the cavity 11.

The selected first or second terminal fitting 20A or 20B is inserted forward into the cavity 11 from the rear. The insertion direction of the first and second terminal fitting 20A and 20B is parallel with the longitudinal direction thereof. More specifically, the insertion direction of the first terminal fitting 20A and the second terminal fitting 20B is parallel with the longitudinal direction of the tabs 26A, 26B inserted into the normal positions of the cavity 11 respectively.

The lower surface of the terminal fitting body 21 interferes with the lance 12 during an early stage of insertion of the first terminal fitting 20A into the cavity 11, as shown in FIG. 3. As a result, the lance 12 flexes elastically towards the flexible space 13 and the lower surface of the connection portion 28A of the tab 26A interfering with the upper surface of the covering panel 31 of the front closure 30. Accordingly, the first terminal fitting 20A inclines up towards the front with respect to a normal horizontal insertion posture. At this time, the terminal fitting body 21 is lower than the in the normal insertion posture of the first terminal fitting 20A, and the terminal fitting body 21 causes the lance 12 to flex elastically down. Thus there is no fear that the tab 26A generates a great stress at the contact position of the tab 26A with the open portion 16 and the front closure 30.

The elastically flexed lance 12 returns resiliently to its original state when the first terminal fitting 20A reaches a normal insertion position and the lance 12 lockingly engages the lock 24. At this time, the front stop 25 strikes the front wall 14 to stop further forward movement of the first terminal fitting 20A. As a result, the first terminal fitting 20A is held in an almost normal insertion state. As shown in FIG. 2, the connection portion 28A of the tab 26A keeps riding on the upper surface of the covering panel 31 when the first terminal fitting 20A is in the normal insertion state. Thus the first terminal fitting 20A inclines up towards the front thereof with the lance 12 elastically flexing to a slight extent.

The front closure 30 then is moved from the wait position to the detection position. As a result, the covering panel 31, in contact with the lower surface of the connection portion 28A, is fit in the open portion 16. The covering panel 31 slides on the lower surface of the proximal portion 27A of the tab 26A and covers the open region that communicates with the cavity 11. The proximal portion 27A is thinner than the connection portion 28A. Thus, the lower surface of the proximal portion 27A is located at a higher position than the lower surface of the connection portion 28A. Therefore the first terminal fitting 20A takes the horizontal normal insertion position. As a result, the lance 12 does not elastically flex, i.e., has a free state. At this time, the proximal portion 27A fit in the fit-in concavity 17 is sandwiched vertically and in the thickness direction of the proximal portion 27A between the upper surface of the covering panel 31 and the inner surface of the fit-in concavity 17 of the open portion 16. Therefore, the tab 26A cannot loosen vertically. The detector 33 of the front closure 30 moves into the flexible space 13 and prevents the lance 12 from elastically flexing away from the lock 24 of the terminal fitting body 21. Therefore the lance 12 reliably prevents the first terminal fitting 20A from being removed.

The rear end of the detector 33 strikes the front end of the lance 12 that is flexed elastically into the flexible space 13, if the front closure 30 is moved towards the detection position while the first terminal fitting 20A is in the partly-inserted state. Thus, the front closure 30 cannot move to the detection position. An inability to move the front closure 30 to the detection position indicates that the first terminal fitting 20A is only in the partly-inserted state. Conversely, an ability to move the front closure 30 to the detection position confirms that the first terminal fitting 20A has been inserted into the normal position of the cavity 11.

The lower surface of the terminal fitting body 21 of the second terminal fitting 20B interferes with the lance 12 during an early stage of insertion of the second terminal fitting 20B into the cavity 11. As a result, the lance 12 elastically flexes towards the flexible space 13 with the connection portion 28B near the front of the tab 26B riding on the upper surface of the covering panel 31 of the front closure 30. The thickness of the tab 26B is constant over the entire length, and the lower surfaces of the connection portion 28B and the proximal portion 27B are aligned. Thus the second terminal fitting 20B keeps a normal horizontal insertion posture.

The elastically flexed lance 12 resiliently returns to its original state and engages the lock 24 when the second terminal fitting 20B reaches the normal insertion position. At this time, the front stop 25 strikes the front wall 14 to prevent the second terminal fitting 20B from moving forward. Thus, the second terminal fitting 20B is held horizontally in the normal insertion state.

The front closure 30 then is moved from the wait position to the detection position. As a result, the covering panel 31 slides along the lower surface of the tab 26B to the lower surface of the proximal portion 27B and into the open portion 16. The second terminal fitting 20B keeps the normal insertion posture while the front closure 30 is being moved. The proximal portion 27A is sandwiched vertically in the thickness direction of the tab 26B between the upper surface of the covering panel 31 and the inner surface of the fit-in concavity 17 of the open portion 16 to prevent the tab 26A from loosening vertically.

As described above, the tabs 26A, 26B extend forward on the male terminal fittings 20A, 20B and are inserted into the cavity 11 in the housing 10 from the rear. The tabs 26A, 26B are inserted through the open portion 16 of the front-surface wall 14 of the cavity 11; and the proximal portions 27A, 27B of the tabs 26A, 26B are sandwiched in the thickness direction between the inner surface of the open portion 16 and the front closure 30 mounted on the open portion 16. The thickness of the proximal portion 27A of the tab 26A of the first terminal fitting 20A is less than the thickness of the connection portion 28A of the tab 26A, which is thicker than the connection portion 28B of the second terminal fitting 20B. Thus, the thickness "ta" of the proximal portion 27A of the tab 26A substantially equals the thickness "ta" of the proximal portion 27B of the tab 26B of the second terminal fitting 20B. Therefore without altering the type of the front closure 30, it is possible to mount both the first terminal fitting 20A and the second terminal fitting 20B on the housing 10.

The front closure 30 is movable between the detection position provided on the open portion 16 and the wait position disposed forward from the detection position. When the terminal fittings 20A, 20B are placed in the half-inserted state, the terminal fittings 20A, 20B are prevented from moving from the wait position to the detection position. On the other hand, when the terminal fittings 20A, 20B are inserted into the normal position of the cavity 11, the terminal fittings 20A, 20B are allowed to move from the wait position to the detection position. The front closure 30 has the function of detecting the inserted state of the terminal fittings 20A, 20B. Thus, there is no need to provide an insertion detector separate from the front closure 30, thereby decreasing the number of parts.

The connection portion 28A of the first terminal fitting 20A protrudes under the proximal portion 27A, so that the connection portion 28A is thicker than the proximal portion 27A towards the front closure 30. Thus, the connection portion 28A interferes with the upper surface of the covering panel 31 of the front wall 30 when the first terminal fitting 20A is inserted into the cavity 11 while the front closure 30 is at the wait position.

The lance 12 on the inner surface of the cavity 11 is elastically flexible down in the direction intersecting the insertion direction of the terminal fittings 20A, 20B into the cavity 11. The elastically flexed lance 12 returns resiliently to its original state when the first terminal fitting 20A is inserted to the normal position and locks the first terminal fitting 20A. The front closure 30 is disposed at the side of the housing 10 in which the lance 12 elastically flexes. Thus, the first terminal fitting 20A inclines up towards the front due to the elastic flexing of the lance 12 when the connection portion 28A interferes with the covering panel 31 of the front closure 30. Therefore, interference of the connection portion 28A with the front closure 30 will not cause the tab 26A to generate an excessively large stress.

The invention is not limited to the embodiment described above. For example, the following embodiments are included in the technical scope of the present invention.

It is possible that the front closure does not function to detect the insertion state of the terminal fitting.

The front wall need not function to prevent the lance from elastically flexing.

Figure 10:
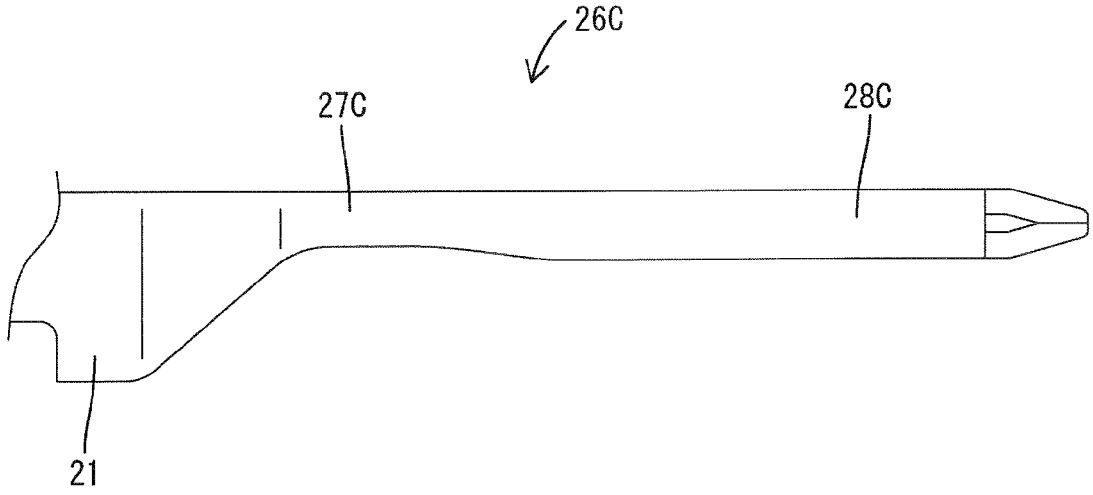
FIG. 10 is a side view in which a modified example of the tab of the first terminal fitting is partly enlarged.

As shown in FIG. 10, a tab 26C of the first terminal fitting may have an upper surface that is continuous and flush from a proximal portion 27C of the tab 26C to a connection portion 28C thereof. However, the lower surface of the connection portion 28C is protruded under the lower surface of the proximal portion 27C.

Figure 11:
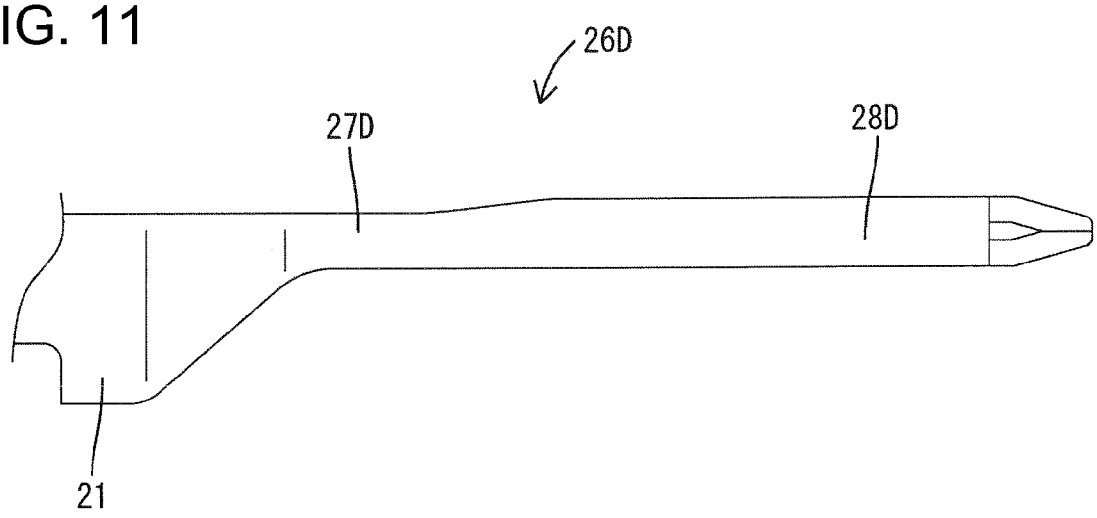
FIG. 11 is a side view in which another modified example of the tab of the first terminal fitting is partly enlarged.

As shown in FIG. 11, a tab 26D of the first terminal fitting has a lower surface that is continuous and flush from a proximal portion 27D to a connection portion 28D, but the upper surface of the connection portion 28D is higher than the upper surface of the proximal portion 27D.

In the above-described embodiment, the thickness of the tab of the second terminal fitting is constant over the entire length. However, the connection portion of the tab of the second terminal fitting may be thicker than the proximal portion thereof, similar to the configuration of the tab of the first terminal fitting.

In this case, the thickness of the proximal portion of the second terminal fitting is equal to that of the proximal portion of the first terminal fitting, and the thickness of the connection portion of the second terminal fitting is different from that of the connection portion of the first terminal fitting.

In the above-described embodiment, two types of terminal fittings can be inserted into one connector. However, the connector may be have at least three types of terminal fittings.

What is claimed is:

1. A connector comprising:

a housing with opposite front and rear ends, a front wall at the front end of said housing and a cavity extending through the housing from the front end to the rear end thereof, an open portion being formed in the front wall at said cavity;

a front closure mounted to the front end of said housing and configured to close at least part of said open portion; and a terminal fitting with opposite front and rear ends, a terminal fitting body in proximity to the rear end of the terminal fitting and a tab extending forward from said terminal fitting body, the tab having a proximal portion adjacent the terminal fitting body and a connection portion forward of the proximal portion, the terminal fitting being mounted in the cavity so that the tab projects forward through the open portion, the proximal portion of said tab being sandwiched in a thickness direction of said tab between said front closure and an inner surface of said open portion, said proximal portion having a thickness that is less than a thickness of the connection portion.

2. The connector of claim 1, wherein said proximal portion has a length that exceeds a thickness of a region of said front closure corresponding to said connection portion.

3. The connector of claim 1, wherein the tab has opposite top and bottom surfaces spaced apart in the thickness direction, portions of the top and bottom surfaces on the connection portion projecting outwardly beyond portions of the respective top and bottom surfaces on the proximal portion.

4. The connector of claim 1, wherein the tab has opposite top and bottom surfaces spaced apart in the thickness direction, portions of one of the top and bottom surfaces on the connection portion being flush and continuous with portions of the top and bottom surfaces on the proximal portion.

5. The connector of claim 1, further comprising a lance in said cavity, said lance being elastically flexible into a flexing space during insertion said terminal fitting into said cavity, the elastically flexed lance returning resiliently towards an original state when said terminal fitting is inserted completely into said cavity for locking said terminal fitting in said cavity.

6. The connector of claim 5, wherein said front closure is movable between a detection position on said housing and a wait position forward of said detection position, said front closure having a detector that is movable into the flexing space for the lance when the terminal fitting is inserted completely into the cavity, the lance contacting the detector and preventing the front closure from moving into the detection position when the terminal fitting is in a partly-inserted state.

7. A plurality of terminal fittings each of which has opposite front and rear ends, all of the terminal fittings having substantially identical terminal fitting bodies in proximity to the rear end of the respective terminal fitting, each of the terminal fittings having a tab extending forward from the respective terminal fitting body, each of the tabs having a proximal portion adjacent the terminal fitting body and a connection portion forward of the proximal portion, the proximal portions of each of the terminal fittings having substantially identical thicknesses, the connection portion of at least one of the terminal fittings having a thicknesses greater than the thickness of the proximal portions.

8. The plurality of terminal fittings of claim 7, wherein the connection portions of at least three of the terminal fittings have thicknesses that are different from one another.

9. A connector comprising:

a housing with opposite front and rear ends, a front wall at the front end and a cavity extending through the housing between the front and rear ends, an open portion formed in the front wall at said cavity;

a front closure mounted to the front end of said housing and configured to close at least part of said open portion; and a plurality of terminal fittings having substantially identical terminal fitting bodies at a rear ends thereof and configured for insertion into the cavity, each of the terminal fittings having a tab forward of the respective terminal fitting body, each tab having a proximal portion adjacent the terminal fitting body and a connection portion forward of the proximal portion, the proximal portions of the terminal fittings having substantially identical thicknesses so that the proximal portion of any of said tabs can be sandwiched between said front closure and an inner surface of said open portion, the connection portion of at least one of the terminal fittings having a thicknesses greater than the thicknesses of the proximal portions.

10. The connector of claim 9, wherein at least one of the tabs has a substantially uniform thickness along an entire length thereof.

11. The connector of claim 9, wherein the connection portions of at least three of the terminal fittings have thicknesses that are different from one another.

12. The connector of claim 9, wherein each of the tabs has opposite top and bottom surfaces spaced apart in the thickness direction, portions of the top and bottom surfaces on the connection portion of at least one of the tabs projecting outwardly beyond portions of the respective top and bottom surfaces on the proximal portion.

13. The connector of claim 9, wherein each of the tabs has opposite top and bottom surfaces spaced apart in the thickness direction, portions of one of the top and bottom surfaces on the connection portion of at least one of the tabs being flush and continuous with portions of the top and bottom surfaces on the proximal portion.

14. The connector of claim 9, further comprising a lance in said cavity, said lance being elastically flexible into a flexing space during insertion said terminal fitting into said cavity, the elastically flexed lance returning resiliently towards an original state when said terminal fitting is inserted completely into said cavity for locking said terminal fitting in said cavity.

15. The connector of claim 14, wherein said front closure is movable between a detection position on said housing and a wait position forward of said detection position, said front closure having a detector that is movable into the flexing space for the lance when the terminal fitting is inserted completely into the cavity, the lance contacting the detector and preventing the front closure from moving into the detection position when the terminal fitting is in a partly-inserted state.

* * * * *